United States Patent [19]

Eckerdt

[11] 4,072,033

[45] Feb. 7, 1978

[54] KEY HOLDER

[76] Inventor: George H. Eckerdt, 948 Culver Road, Rochester, N.Y. 14609

[21] Appl. No.: 690,983

[22] Filed: May 28, 1976

Related U.S. Application Data

[63] Continuation-in-part of Ser. No. 583,047, June 2, 1975, abandoned.

[51] Int. Cl.[2] ..... A47G 29/10

[52] U.S. Cl. ..... 70/456 B; 70/459

[58] Field of Search ..... 70/456 R, 456 B, 457, 70/458, 459; 24/204, 3 K; 116/133; 150/40

[56] References Cited

U.S. PATENT DOCUMENTS

| | | | |
|---|---|---|---|
| 2,228,720 | 1/1941 | Loesch | 70/456 B |
| 3,280,967 | 10/1966 | Bergh | 70/456 B |
| 3,415,300 | 12/1968 | Worcester | 150/40 |
| 3,620,057 | 11/1971 | Holland | 70/456 R |
| 3,716,091 | 2/1973 | Grines | 150/40 |

*Primary Examiner*—Robert L. Wolfe

*Attorney, Agent, or Firm*—Stonebraker, Shepard & Stephens

[57] ABSTRACT

A key holder uses a resin support sheet or body, preferably in the form of a molded resin case having two portions hingedly joined together. Several strips each formed as one part of a two-part hook-and-loop pile fastener are secured to the inside of the case or to the resin support sheet to be approximately perpendicular to the hinge line and parallel with each other. A substantial number of key tags are cut from a strip of extruded resin joined to the other part of the two-part hook-and-loop fastener, and the key tags are preferably die cut to have a hole for receiving a key ring to support a key. Several of the key tags are attachable to each of the strips to support a number of keys in a row along each of the strips. The key tags are preferably formed from the loop portion of the fastener, and resilient foamed resin material is preferably used in the case to hold the keys in place when the case is closed.

19 Claims, 12 Drawing Figures

KEY HOLDER

RELATIONED APPLICATIONS

This is a continuation-in-part of my copending application Ser. No. 583,047, filed June 2, 1975, entitled KEY HOLDER, and abandoned upon the filing of this continuation-in-part application.

THE INVENTIVE IMPROVEMENT

Some situations require ready access to many keys — for example, real estate management or building security involving many building locks, and motor vehicle operation such as automobile dealerships, service garages, truck and taxi fleets, and parking garages. If the many keys involved in some operations are not securely stored and efficiently displayed, they can be jumbled together, tangled, difficult to sort through and select, or easily lost or stolen. Also, some key holders must be conveniently portable and yet capable of storing a large number of keys. Furthermore, any portable key holder must securely retain keys in any orientation and yet allow easy key removal and replacement.

The invention involves analysis of all these problems, and realization of a way that a key holder can be made more simple and efficient to meet all the needs in an economical and practical way. The invention aims at a better key holder that is more versatile and convenient and is still very inexpensive.

SUMMARY OF THE INVENTION

In one preferred form, the inventive key holder uses a case formed of a pair of molded resin portions hingedly joined together. A plurality of strips, each formed as one part of a two-part hook-and-loop pile fastener are secured to the inside of each of the case portions, either directly or to the inside of a foamed resin body in each half of the case, to be approximately perpendicular to the hinge line and approximately parallel with each other. A plurality of key tags are each preferably die cut from a strip of extruded resin joined to the other part of the two-part hook-and-loop fastener, and each of the key tags has a hole for receiving a key ring to support a key. Several of the key tags are attachable to each of the strips to support a number of keys in a row along each of the strips. The case can also have a sheet of resin material hinged on an axis parallel with the hinge line of the case and bearing several of the strips to support additional rows of keys, and several pivoted sheets can be mounted in the case if the case encloses sufficient volume. Resin sheets bearing fastener strips can also be arranged in a looseleaf notebook.

DRAWINGS

DETAILED DESCRIPTION

Figure 1:
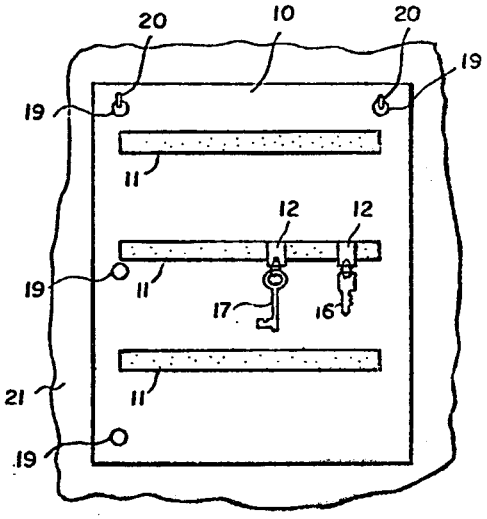
FIG. 1 is a front elevational view of one preferred embodiment of the inventive key holder.
Figure 2:
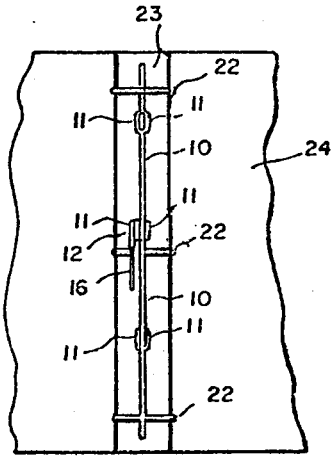
FIG. 2 is a fragmentary, side elevational view of the key holder of FIG. 1 in a ring binder.
Figure 3:
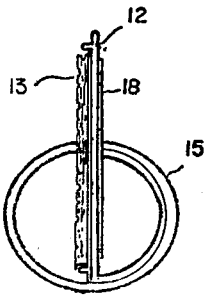
FIG. 3 is an enlarged, top view of a key tag preferred for use with the inventive key holder.
Figure 4:
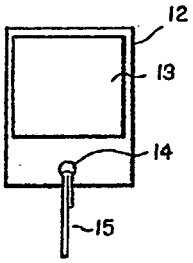
FIG. 4 is a front elevational view of the key tag of FIG. 3.
Figure 5:
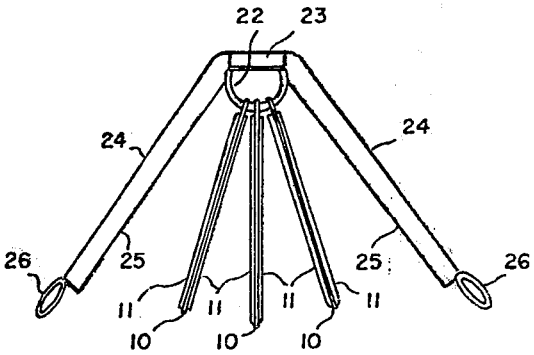
FIG. 5 is a top view of a preferred embodiment of the inventive key holder arranged in a ring binder.

One preferred embodiment of the inventive key holder as illustrated in FIG. 1 uses a base sheet 10 preferably formed of a resin material. Several different resin materials are suitable, and base sheet 10 is preferably sturdy enough to support the weight of many keys without folding or collapsing. For appearance sake, base sheet 10 preferably has an embossed surface.

Strips 11 are secured to base sheet 10 to support rows of keys, and strips 11 are formed of one part of a two-part hook-and-loop pile fastener material. Preferably, strips 11 are formed of the hook part of the hook-and-loop pile fastener and are securely attached to base sheet 11 by a reliable adhesive or solvent bond. Strips 11 are oriented on base sheet 10 in preferably parallel relation to extend horizontally as illustrated when base sheet 10 is in its ordinary display orientation.

Strips 11 are commercially available as a fabric strip having the hook portion of a hook-and-loop pile fastener and backed with a resin material specially prepared for solvent bonding. Methylethyl keytone is a typical solvent for bonding the backs of strips 11 to a resin sheet or body, and support sheets 10 or other resin support bodies are preferably formed of a material that is also soluble in methylethyl keytone so that application of the solvent for bonding strips 11 to a resin sheet or body produces a very secure and convenient attachment for strips 11. Normal wear and tear in attaching and removing keys and supporting the weight of keys is then insufficient to loosen strips 11 from their anchorage, so that the inventive key case has a long wear life.

A substantial number of key tags 12 are also preferably formed of resin material and have a piece of the other, or preferably loop portion, of the hook-and-loop pile fastener 13 secured to their backs. Each key tag 12 has a hole 14 near its bottom edge, and a key ring 15 is secured in hole 14 to support a key 16 or 17. Key tags 12 are preferably formed from a resin extrusion of an indefinite length secured directly to fastener pieces 13 to form a strip that is cut into individual tags 12 by a die that also punches holes 14. A label 18 of paper, foil, plastic, or other material is preferably secured to the front face of key tag 12 to identify the key suspended from ring 15.

Figure 10:
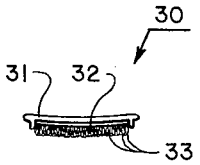
FIG. 10 is a side-elevational view of the key tag strip of FIG. 9.
Figure 9:
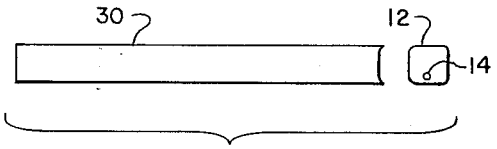
FIG. 9 shows a die-cut key tag separated from a strip from which key tags are cut.

The preferred way of forming key tags 12 is best shown in FIGS. 9 and 10. Strips 30 are commercially available in four-foot lengths with an extruded resin backing 31 securely attached to a fabric base 32 supporting fastener loops 33. Fabric base 32 and loops 33 are apparently securely joined to resin backing strip 31 during manufacture so that key tags 12 can be punched out from strip 30 by using a simple die that preferably rounds the corners of key tags 12 and punches out hole 14 in a single operation. It is then necessary only to advance strip 30 through die-punching equipment to produce a large number of key tags 12 that are both ready to use and also have a secure bond between the resin backing strip 13 and the loop portion 33 of the fastener. Resin backer 31 is suitable for attachment of identifying labels or for marking directly with a marking pen, and no assembly, or gluing or bonding is required.

The user of the inventive key holder places each key on a ring 15 and attaches each ring and key to a key tag 12, and then merely presses key tags 12 against fastener strips 11 on base sheet 10 to arrange the keys in rows for display and storage. The illustrated key holder can be sold as a set of base sheets 10 having strips 11, and a number of key tags 12 and rings 15 for the user to assemble.

Base sheet 10 has holes 19 near its upper edge so that it can be hung on hooks 20 on wall 21 to display keys. This is especially useful where keys need to be accessible and on display at a particular place during the working day. After business hours, base sheet 10 can be removed from hooks 20 and locked up for the night.

Base sheet 10 has some additional holes 19 along one side edge, and side holes 19 are spaced to fit on the rings 22 of a ring binder 23. Several base sheets 10 can then be carried in ring binder 23 which preferably has a cover 24 that can be closed by a zipper 25 and carried by handles 26 to form a convenient and portable key holder. Ring binder 23 then appears to be a small brief case and is securely closeable to protect the keys, and base sheets 10 are then analogous to pages that can be turned when ring binder 23 is opened. Base sheets 10 preferably have fastener strips 11 secured to both opposite face surfaces so that keys can be arranged on each side of each base sheet 10. A hundred or more keys are then easily and conveniently arranged on base sheets 10 and carried about in ring binder 23 for quick access. Any selected key is quickly and easily released from fastener strip 11, used, and quickly replaced by merely pressing key tag 12 back against fastener strip 11.

Figure 6:
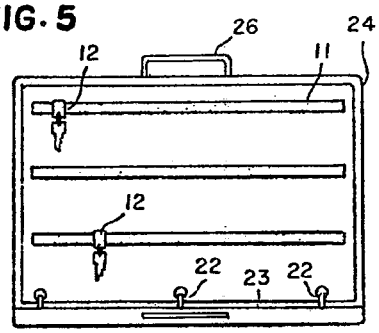
FIG. 6 is an elevational view of another preferred embodiment of the inventive key holder arranged in a ring binder.

Strips 11 on base sheet 10 can also be arranged parallel with ring binder 23 as best shown in FIG. 6 with keys hanging toward and in between rings 22 when the keycase is carried about and used. If the keycase is opened in the orientation of FIG. 6 and base sheets 11 are turned from vertical to horizontal, the keys remain neatly and conveniently vertical and hang straight downward while the keycase is used. Also, such an arrangement is slightly more compact, because the lower ends of the keys can hang down between rings 22. Furthermore, if any keys come loose in the case, they tend not to fall out if the case is opened in the orientation of FIG. 6.

One of the basic advantages of the invention is the easy removal and replacement of keys from fastener strips 11, while maintaining the security of the key retention. Keys tend to stay in place in any orientation, even when the key holder is turned upside down or sideways, and key tags 12 do not have to be fitted into slots or placed over hooks or otherwise exactly placed back on the holder, because any key tag 12 can be securely fastened anywhere along a fastener strip 11. Although the retention of keys is quite secure, the removal and replacement is quicker and easier than any prior art key holder.

Fastener strips 11 can be mounted on bases that are substantially the same width as strips 11, and these can be secured directly to a wall, door, cupboard, file cabinet, safe, box, etc. Strips 11 can be fastened to hinged doors or panels in a wall-mounted cabinet or box and can be arranged on trays or decks within a box that separates the trays as the box is opened. Fastener strips 11 can be arranged within a key holder small enough to be carried in a pocket for carrying a few keys, or can be formed as many long strips on a number of large panels to hold hundreds of keys.

Ring binders for the invention can have different numbers of rings and can range from relatively small, open notebook type of holders to relatively large leather or plastic-covered holders with zippers, closure hasps, locks, handles, etc. Base sheets 10 are readily cut from suitable resin material, and key tags 12 are easily made in large quantities. The only assembly required before sale is securing fastener strips 11 to base sheets 10. Depending upon the size of base sheet 10 and the size of the keys to be displayed, different numbers of strips 11 can be arranged on base sheet 10.

Key tags 12 can be secured to strips 11 anywhere along the length of strips 11 so that keys can be fairly spread out or packed relatively closely together and can easily be arranged in any order that the user desires. Less frequently used keys can be grouped together in one portion of the holder, and more frequently used keys can be grouped together and spread out a little for more convenient access. Fastener parts 11 and 13 support keys very reliably, and key tags 12 can hold several related keys without danger of coming loose from fastener strips 11. Labels 18 can be formed of paper with an adhesive coating, or of embossed resin with an adhesive coating, or labels 18 can be omitted, and key identification can be marked directly on key tags 12 with a suitable marker. If labels are used, replacement labels can be adhered over previous labels.

The reason that the hook portion of the two-part fastener is preferably used for strips 11 on base sheet 10 is that having the loop portion 13 of the two-part fastener on key tag 12 is more convenient if the key on tag 12 is placed in a pocket. The loops of fastener portion 13 do not stick to or catch onto things as much as the hook portion used for strips 11. Otherwise, fastener portions 11 and 13 can be reversed with the same general effect.

Figure 7:
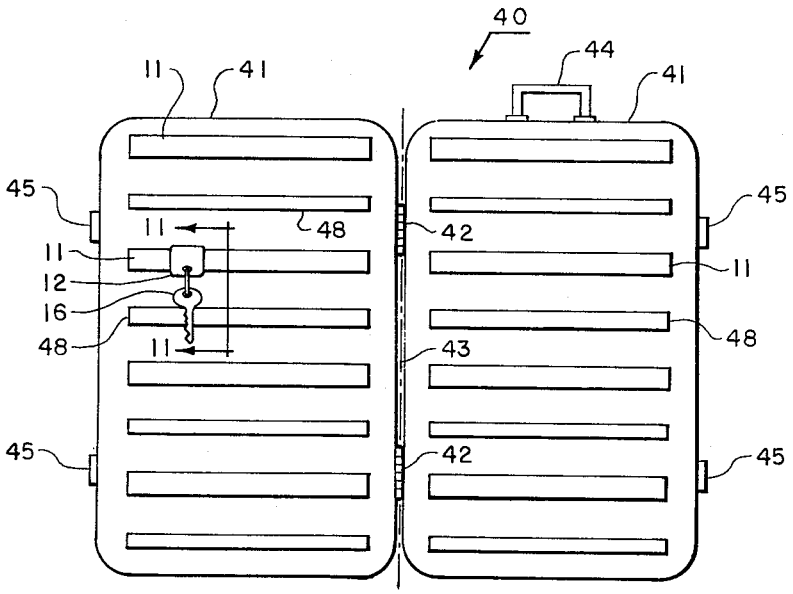
FIG. 7 is a partially schematic, elevational view of another preferred embodiment of the inventive key holder applied to a molded resin case.
Figure 8:
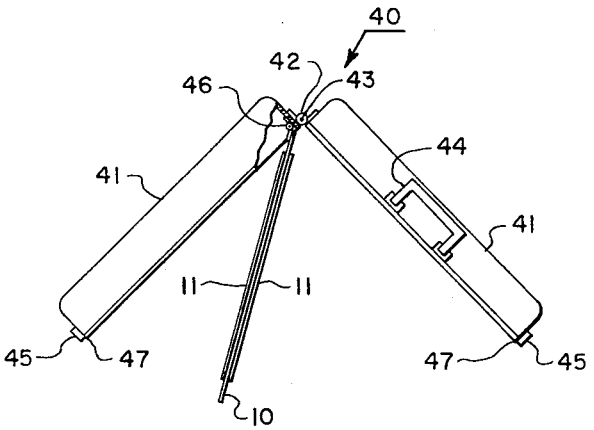
FIG. 8 is a partially schematic, and partially cut-away plan view of a case similar to the case of FIG. 7 and having an additional sheet.
Figure 11:
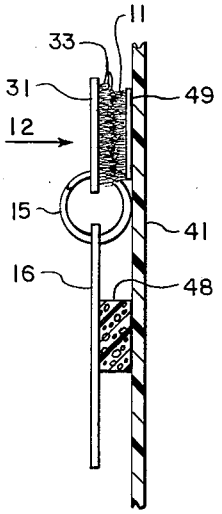
FIG. 11 is a fragmentary, cross-sectional view of the case of FIG. 7 taken along the line 11—11 thereof.

FIGS. 7, 8, and 11 show application of the inventive key holder to a case 40, which is preferably formed of two identical portions 41 that are preferably vacuum formed of resin material. Vacuum-formed resin cases are generally known and used for brief cases or attache cases, and portions 41 are each hollow bodies that are joined together by hinges 42 along a hinge line 43 for opening and closing in a generally known manner. Application of generally known trim strips, a handle 44, and latches 45 complete the case 40, which is conventional, except for having handle 40 preferably arranged along an edge adjacent hinge line 43 instead of opposite hinge line 43.

The inward-facing surfaces of case portions 41 are of resin material, and are preferably soluble in the same solvent, such as methylethyl keytone, for making a solvent bond with the backing of fastener strips 11 so that strips 11 are securely anchored to the inside surfaces of case portions 41. This provides two large and generally planar areas for attaching key tags 12 to the case itself without requiring separately supported resin backing sheets 10. A relatively shallow or thin case 40 can be substantially filled with the keys that are securable to strips 11 fastened to the inward-facing surfaces of case portions 41, but for thicker cases 40 and for an even larger number of keys, one, two, or more base sheets 10 are attached to the case portions 41, preferably by hinges 46 forming a hinge axis parallel with the hinge line 43 of case hinges 42. A base sheet 10 can be hingedly mounted on each case portion 41 adjacent hinges 42, or base sheets 10 can be hingedly mounted adjacent the closing edges 47 of case portions 41. Again, base sheets 10 are preferably stiff enough to be self supporting under the weight of many keys, and base sheets 10 can have fastener strips 11 secured to both sides for fastening keys on both sides of a sheet 10, so long as room is available in case 40.

To help reduce the noise of keys clanking against the inside surfaces of case portions 41, resilient strips 48 are preferably secured to the inward-facing surface of case portion 41 to be spaced from and parallel with fastener strips 11 as illustrated. Then keys 16 supported on any of the strips 11 rest against resilient strips 48 and stay out of contact with the surface of case portions 41 to reduce the noise. Resilient strips 48 can be formed of a variety of materials and are preferably a foamed resin such as a foamed urethane or synthetic rubber with an adhesive backing so that strips 48 are readily and easily securable to the inward-facing surfaces of case portions 41. Since strips 48 do not bear loads, their attachment to case portions 41 need not be as secure as for fastener strips 11.

The cross-sectional view of FIG. 11 shows the resin wall of case portion 41 and the solvent bonded resin backing 49 securing fastener strip 11 to resin wall 41. Resin backing strip 31 secured to fastener loops 33 is supported on strip 11 and in turn supports ring 15 and key 16 in contact with resilient strip 48.

Use of a resin-walled case for direct solvent bonding of strips 11, and die-cutting of key tags 12 from an extruded and factory-bonded strip 30 not only reduces the cost of practicing the invention, but also increases the efficiency and convenience. Vacuum-formed case portions 41 are relatively inexpensive, and latches 45 and handle 44 are economically applied in generally known ways so that a large number of keys can be mounted on the inward-facing surfaces of case portions 41. Then by enlarging case portions 41 a little and adding hinged base sheets 10, a multitude of keys can be conveniently and neatly stored in an easily usable fashion in a readily portable container. Present projections indicate a cost-per-key for the inventive key holder of substantially less than for key holders presently being marketed.

Figure 12:
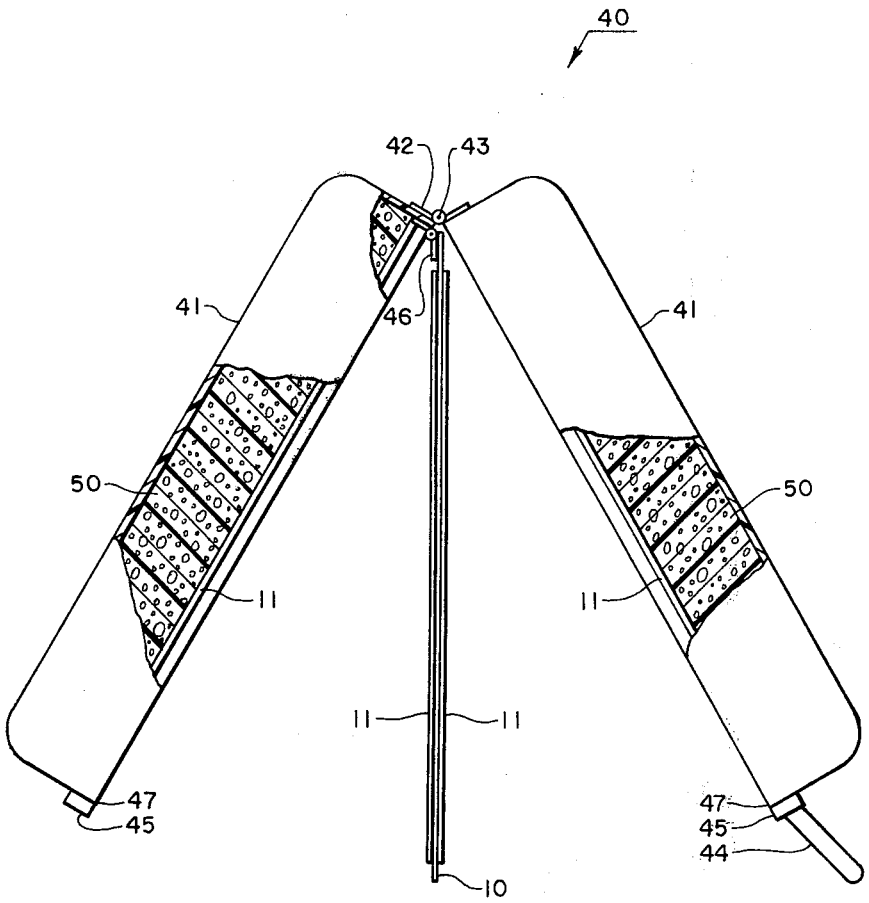
FIG. 12 is a partially schematic, and partially cut-away plan view of a case similar to the case of FIG. 8 and having foamed resin cushioning.

FIG. 12 shows a preferred variation on the case 40 of FIGS. 7–11, which is generally as described above, except for the addition of resilient, foamed resin bodies 50 secured to the inside of each case portion 41. Foamed bodies 50 are preferably bonded to case portions 41 by a solvent or adhesive bond, and can be formed of a variety of resilient foam materials, including polyurethane foam. Key support strips 11 are then secured directly to foamed resin bodies 50, preferably by the same methylethyl keytone or other solvent bond described above for securing strips 11 to case portions 41. Support strips 11 are then resiliently mounted on compressible bodies 50 to grip and hold keys in place when case 40 is closed.

The spacing between foamed bodies 50 in opposite portions 41 of case 40 can range from zero to a gap small enough so that keys are pressed against foamed bodies 50 when case 40 is closed. The closure gap between opposed foamed bodies 50 is preferably adjusted relative to the total number of keys intended for case 40 so that bodies 50 are compressed somewhat by the load of keys which are then held firmly in place when case 40 is closed. The closure gap between foamed bodies 50 is never made so small relative to the total volume of keys as to require excessive force to close the case, and a central hinged sheet 11 for additional keys can be accommodated by widening the gap. Keys trapped and squeezed between foamed bodies 50 are more securely held in place and cannot come loose or make noise as case 40 is moved about in different orientations. This makes case 40 even more secure and quiet in holding keys in place and does not substantially increase the cost or weight of the inventive key holder. Strips 11 can be oriented parallel with the axis of case hinges 42 or arranged in any other desired orientation when foamed bodies 50 are used, because keys cannot move about when case 40 is closed, regardless of the orientation of the case.

The invention is versatile, convenient, and economical in providing a reliable and easily changeable display for a large number of keys that can be carried about comfortably in a ring binder or hung up for display during working hours. Those workers who have experienced problems in keeping a large number of keys well organized and securely arranged for easy access will appreciate the ways that the invention can be put to use in solving their problems with minimal expense.

In addition to use as a carrying case, the cases 40 of FIGS. 8 and 12 can be made to open up flat and be hung directly on a wall similar to the hanging of sheet 10. Hooks or case handles 44 can be arranged for supporting cases 40 on hooks on a wall during business hours, and then case 40 can be taken down, closed, and removed or locked up for the night.

I claim:

1. A key holder comprising:

a. a base sheet;

b. means for supporting said base sheet to display keys, said support means comprising a ring binder having rings releasably holding said base sheet by a plurality of holes in said base sheet registering with said rings of said ring binder;

c. said base sheet having a strip formed of one part of a two-part hook-and-loop pile fastener material;

d. a plurality of key tags;

e. a piece of the other part of said two-part hook-and-loop pile fastener secured to a rear face of each of said key tags for removably fastening each of said key tags anywhere along said strip;

f. each of said key tags having a hole; and g. a key ring in said hole in each of said key tags for connecting a key to each of said key tags for suspending said keys from said key tags when said key tags are fastened to said strip.

2. The key holder of claim 1 including a plurality of said base sheets for said ring binder and a plurality of said strips on each of said base sheets.

3. The key holder of claim 2 including a plurality of said strips arranged in parallel relation on each face of said base sheets.

4. The key holder of claim 3 wherein said strip on said base sheet is formed of the hook part of said two-part fastener.

5. The key holder of claim 4 wherein said base sheet is formed of resin material and said key tags are formed of resin material.

6. The key holder of claim 5 including key identification means on a front face of each of said key tags.

7. The key holder of claim 1 wherein said strip on said base sheet is formed of the hook part of said two-part fastener.

8. The key holder of claim 1 wherein said base sheet is formed of resin material.

9. The key holder of claim 1 wherein said key tags are formed of resin material.

10. A key holder comprising:

a. a resin support element stiff enough to maintain a generally planar shape;

b. a plurality of strips each formed as a resin-backed hook part of a two-part hook-and-loop pile fastener;

c. a solvent bond securing each of said strips to said resin support element in mutually parallel and spaced relation;

d. a plurality of key tags, each die cut from a strip of extruded resin joined to the loop part of said two-part hook-and-loop fastener and each having a die-cut hole for receiving a key ring to support a key;

e. several of said key tags being attachable to each of said strips to support a plurality of keys in a row along each of said strips; and f. a hand-carriable case, and means for hingedly mounting said resin support element in said case.

11. The key holder of claim 10 wherein said resin support element is a body portion of said hand-carriable case.

12. The key holder of claim 10 wherein several of said strips are secured to each side of said support element to support keys on each side of said resin sheet.

13. A key holder comprising:

a. a case formed of a pair of molded resin portions hingedly joined for opening and closing;

b. a resilient and compressible foamed resin body secured to the inside of at least one of said case portions;

c. a plurality of strips each formed as one part of a two-part hook-and-loop pile fastener;

d. several of said strips being secured to the inward facing surface of said foamed body;

e. a plurality of key tags, each cut from a strip of extruded resin joined to the other part of said two-part hook-and-loop fastener;

f. each of said key tags having a hole for receiving a key ring to support a key;

g. several of said key tags being attachable to each of said strips to support a plurality of keys in a row along each of said strips; and h. means for engaging said keys attached to said strips when said case is closed and for forcing said keys compressibly into said foamed body to hold said keys in place.

14. The key holder of claim 13 wherein said strips have the hook portion of said fastener and said key tags have the loop portion of said fastener.

15. The key holder of claim 13 wherein said strips are approximately perpendicular to the pivot axis between said case portions and approximately parallel to each other.

16. The key holder of claim 13 including a sheet of resin material stiff enough to maintain a generally planar shape, means for hingedly mounting said resin sheet in said case between said foamed bodies, and several of said strips secured to said resin sheet to support a plurality of said key tags and keys.

17. The key holder of claim 16 wherein said strips are approximately perpendicular to the pivot axis between said case portions and approximately parallel to each other.

18. The key holder of claim 17 wherein said strips have the hook portion of said fastener and said key tags have the loop portion of said fastener.

19. The key holder of claim 13 wherein said foamed body is secured to each of said case portions and said foamed bodies provide said means for engaging and forcing said keys.

* * * * *